US006189328B1

(12) United States Patent
Mochizuki

(10) Patent No.: US 6,189,328 B1
(45) Date of Patent: Feb. 20, 2001

(54) SEPARATE TYPE AIR CONDITIONER AND ASSEMBLY METHOD THEREOF

(75) Inventor: Koji Mochizuki, Shiga (JP)

(73) Assignee: Matsushita Electric Industrial Co., Ltd., Osaka (JP)

( * ) Notice: Under 35 U.S.C. 154(b), the term of this patent shall be extended for 0 days.

(21) Appl. No.: 09/198,717

(22) Filed: Nov. 24, 1998

(30) Foreign Application Priority Data

Nov. 28, 1997 (JP) ..... 9-327764

(51) Int. Cl.[7] ..... F25D 19/00
(52) U.S. Cl. ..... 62/298; 74/553
(58) Field of Search ..... 62/298, 262; 74/553

(56) References Cited

U.S. PATENT DOCUMENTS 4,977,750 * 12/1990 Metcalfe ..... 62/77
5,101,471 * 3/1992 Bill ..... 392/449
5,185,804 * 2/1993 Watanabe ..... 381/86
5,199,273 * 4/1993 Silva et al. ..... 62/298
5,377,503 * 1/1995 Reedy et al. ..... 62/326
5,461,880 * 10/1995 Bolton et al. ..... 62/298
5,467,610 * 11/1995 Bolton et al. ..... 62/262

* cited by examiner

*Primary Examiner*—William Doerrler
*Assistant Examiner*—Mark Shulman
(74) *Attorney, Agent, or Firm*—Rather & Prestia

(57) ABSTRACT

A separate type air conditioner has an indoor unit and an outdoor unit. The indoor unit comprises (a) a base frame, (b) a power source board incorporating a control device, (c) operation members mounted on the power source board, and (d) a front grille incorporating an operation unit, being disposed in the base frame to cover said power source board, in which the operation unit has guides, and the operation members are led by the guides and fitted into the front grille.

52 Claims, 7 Drawing Sheets

FIG. 3
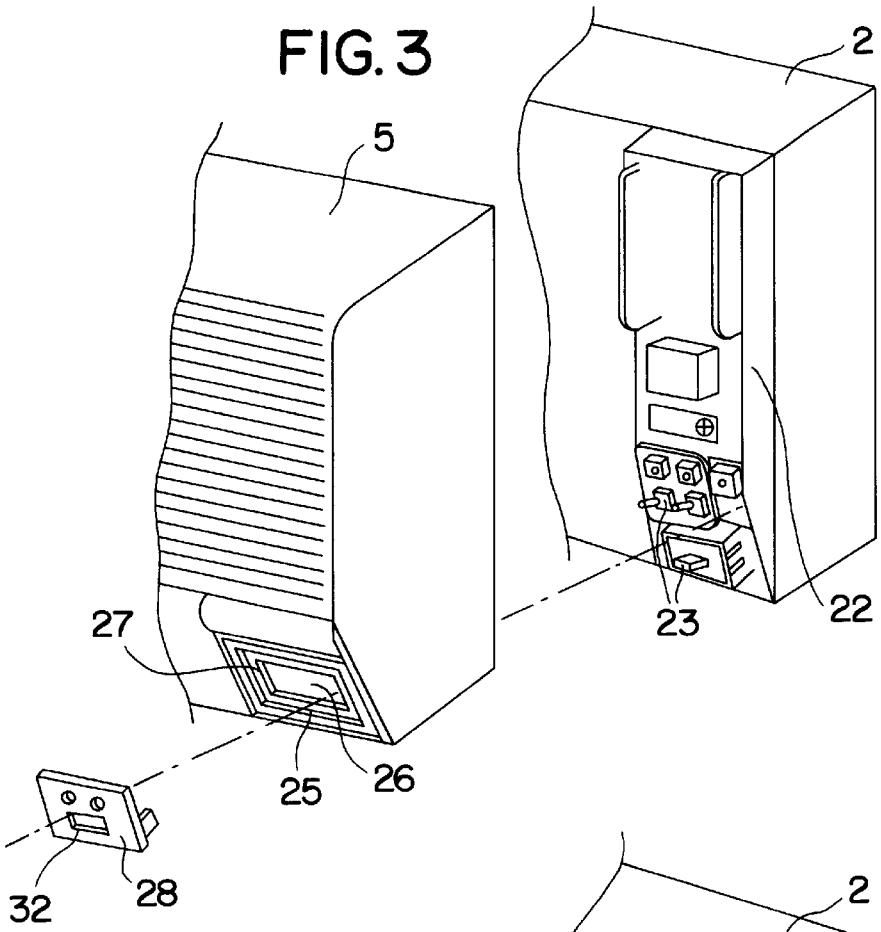
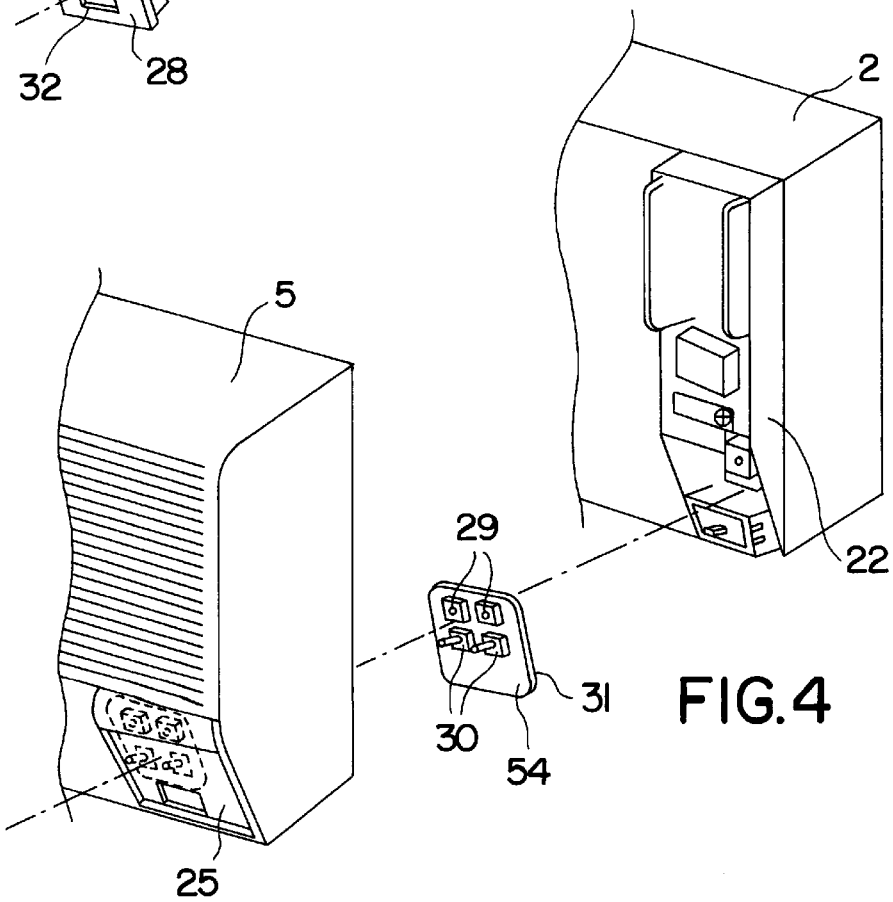
FIG. 4

The indoor heat exchanger, indoor blower and power source board are installed in the base frame. The operation members are installed in the power source board.

↓

↓

The front grille having the operation unit is installed in the base frame, covering the indoor heat exchanger and blower.

The fitting guide is formed in the operation unit, and as being led by this fitting guide, the operation members are fitted into the front grille.

FIG. 7

SEPARATE TYPE AIR CONDITIONER AND ASSEMBLY METHOD THEREOF

FIELD OF THE INVENTION

The present invention relates to a separate type air conditioner. In particular, an air conditioner has been disclosed which has been designed in a manner to facilitate assembly thereof.

BACKGROUND OF THE INVENTION

Referring to FIG. 8, an indoor unit of a separate type air conditioner is described below. FIG. 8 shows a motor 103 driver cross flow fan 104 and is disposed inside base frame 102 forming the bottom of an indoor unit main body 101. Front grille 105 is shown attached to base frame 102. An indoor air suction port 106 is opened in front grille 105. The indoor air sucked in from indoor air suction port 106 passes through air filter 107 installed behind the indoor air suction port 106, and flows into an indoor side heat exchanger 108 assembled in base frame 102. The indoor side heat exchanger 108 absorbs the heat from the indoor air and dehumidifies it at the same time. This produces condensate which is poured into water tray 110 provided in diffuser grille 109. Further, the heat-exchanged air passes through diffuser unit 111 of diffuser grille 109, and is blown out from air diffuser 112 which is opened in front grille 105.

The assembly procedure of the indoor unit main body 101 is described below. On one end, cross flow fan 104 is temporarily fitted to motor base 113 provided in base frame 102. Bearing 114 is fitted to the other end of cross flow fan 104, and is fitted into bearing 115 provided in base frame 102. Indoor side heat exchanger 108 is attached to front of the cross flow fan 104. Diffuser grille 109 integrally comprising water tray 110 and diffuser unit 111 is installed beneath indoor side heat exchanger 108. Power source board 116 incorporating a control device is assembled in base frame 102 ahead of motor 103. Motor 103 is held in place by power source board 116. Display lamp 117, receiver 118 for receiving radio wave from a remote controller, power switch 119 for turning on or off the power source, automatic operation switch 120 for operating the unit automatically, and a test run switch 121 are arranged and installed ahead of power source board 116. Display lamp 117 comprises an operation lamp showing the control device and control state, a timer lamp, and others. Automatic operation switch 120 enables automatic operation of the unit in case of battery drain of the remote controller, or loss or malfunction of the remote controller. Test run switch 121 is used for testing the operation of the unit after installation or moving. Finally, front grille 109 is shown hooked on pawl 122 provided in base frame 102. Power switch 119, automatic operation switch 120 and test run switch 121 protruding from power source board 116 are inserted into a switch hole 124 provided in operation unit 123 of front grille 109.

However, in such structure of a front grille operation unit of the conventional separate type air conditioner, the protruding switches cannot be easily inserted into the switch hole provided in the front grille operation unit. Accordingly, during assembly a complicated work is required to put the switches correctly in place. Besides, the front grille is detached from the assembly when shipped, and needs to be attached when the unit is installed or serviced. In this process, the switches may be deviated from the hole center or dislocated from the hole. As a result, an abnormal stress is applied to the switches, and the switches interfere with the front grille, which causes problems.

SUMMARY OF THE INVENTION

The separate type air conditioner of the invention includes an indoor unit and an outdoor unit. The indoor unit comprises (a) a base frame, (b) a power source board having a control device, (c) operation members mounted on the power source board, and (d) a front grille having an operation unit, being disposed in the base frame to cover the indoor heat exchanger and the blower, in which the operation unit has guides, and the operation members are led by the guides and fitted into the front grille.

The assembly method of an indoor unit of a separate type air conditioner of the invention comprises (a) a step of disposing a power source board in a base frame, (b) a step of mounting operation members having a guide in the power source board, and (c) a step of disposing a front grille incorporating an operation unit, in the base frame to cover the power source board, in which at step (c), as being led by guides formed in the operation unit, the operation members are fitted into the front grille.

In this configuration, the installation position of the operation members is stabilized. Moreover, positioning is easy between the operation unit of the front grille and the operation members installed in the power source board. The operation members are installed in the operation unit positioned precisely. The front grille can be easily installed in the base frame.

BRIEF DESCRIPTION OF THE DRAWINGS

FIG. 2(*b*) is a sectional view of essential parts of the separate type air conditioner shown in FIG. 1.

FIG. 3 is another perspective exploded view of a power source board and a front grille of the separate type air conditioner shown in FIG. 1.

FIG. 4 is a exploded view from a different and perspective of a power source board and a front grille of the separate type air conditioner shown in FIG. 1.

FIG. 5(*b*) is a sectional view of essential parts of the separate type air conditioner shown in FIG. 5(*a*).

FIG. 6(*b*) is a sectional view of essential parts of the separate type air conditioner shown in FIG. 6(*a*).

FIG. 7 is a process diagram showing an assembly method of an indoor unit of a separate type air conditioner of the invention.

DETAILED DESCRIPTION OF THE INVENTION

The present invention comprises an operation unit having an opening formed in a front grille of an indoor unit, an operation switch panel of various switches installed in the power source board, and a front grille fitted in by fitting guides formed in the outer casing of the opening of the operation unit of the front grille. In this constitution, the operation unit of the front grille and the switches arranged in the power source board can be easily installed in position according to design parameters, realizing a stable assembly.

In the present invention, after the operation unit installed in the front grille of the indoor unit is opened and the front grille is installed in the indoor unit main body, a detachable operation switch panel is fitted opposite to the switches arranged in the power source board projecting to the opening of the operation unit of the front grille. In this constitution, the front grille can be mounted easily, and the operation switch panel can be mounted securely without any interference or applying abnormal stressed on the switches.

In the present invention, an electronic control device installed in the printed circuit board is mounted on the operation unit, and is installed in the indoor unit main body. The electronic control device includes a display unit having an operation lamp, a timer lamp, an automatic operation switch, and a test run switch. In this constitution, a secure mounting of the front grille is easily achieved securely.

In the present invention, guides are formed in the operation unit to guide the switches into the switch hole formed in the operation unit of the front grille. In this constitution, when installing the front grille in the indoor unit main body, the switches can be fitted without any interference or applying abnormal stresses to the switches.

In the present invention, the switch hole in the operation unit of the front grille is preliminarily opened larger than the design dimensions. After the operation unit is installed in the indoor unit main body, a detachable switch hole lid having a switch hole is fitted in. In this constitution, the front grille can be installed easily, and the front grille can be installed without any interference or applying abnormal stresses to the switches.

Preferred embodiments of the invention are described below while referring to FIG. 1 to FIG. 7.

Exemplary Embodiment 1

The structure of the outdoor unit main body of the separate type air conditioner is the same as in the prior art mentioned above, and detailed description of the structure of the outdoor unit main body is omitted.

Figure 1:
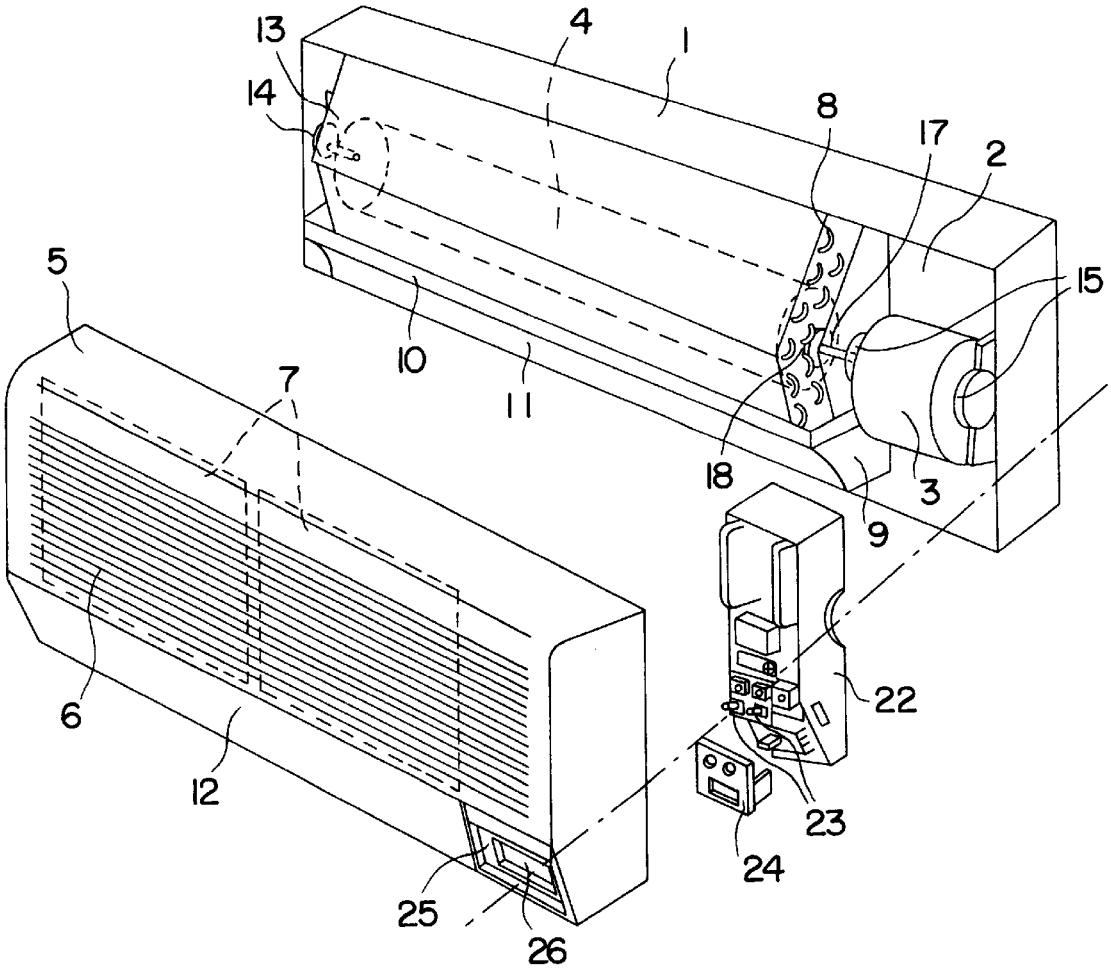
FIG. 1 is a perspective exploded view of an indoor unit main body of a separate type air conditioner in an exemplary embodiment of the invention.
Figure 2A:
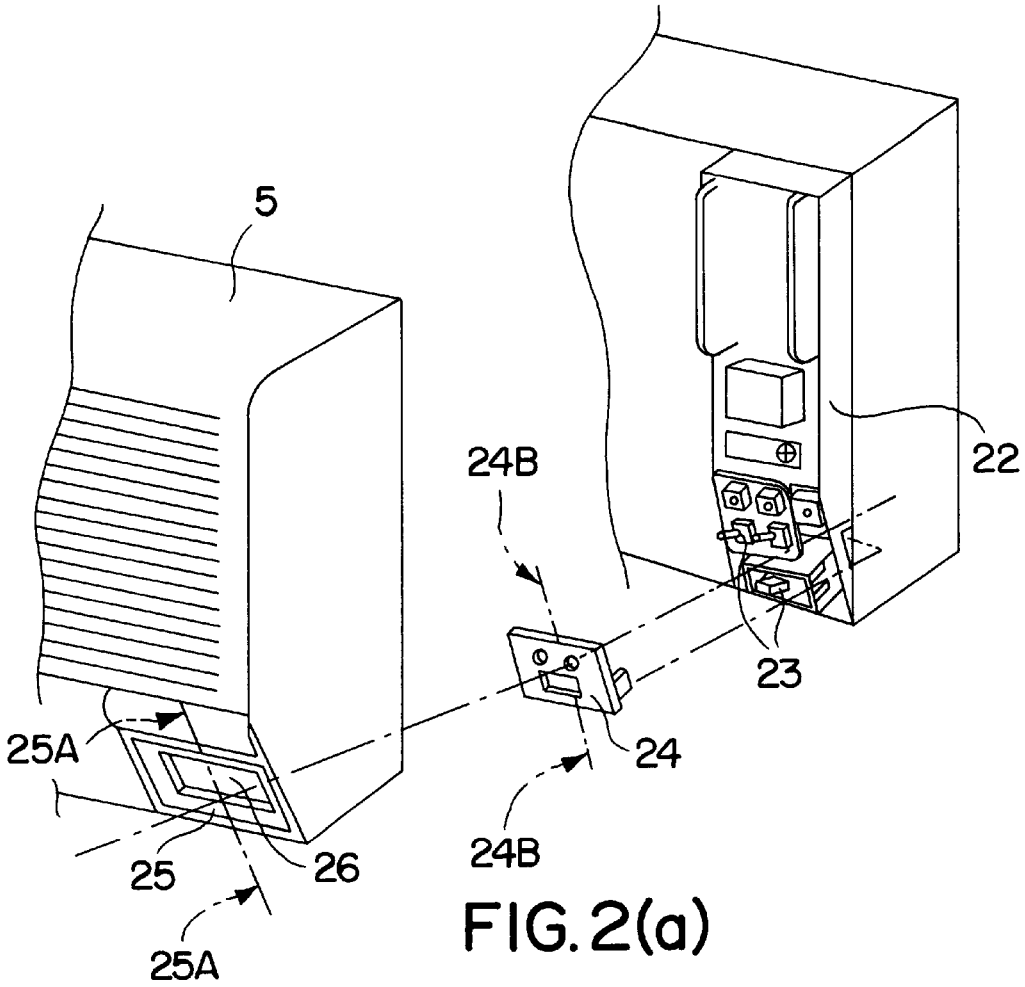
FIG. 2(*a*) is a perspective exploded view of a power source board and a front grille of the separate type air conditioner shown in FIG. 1.
Figure 2B:
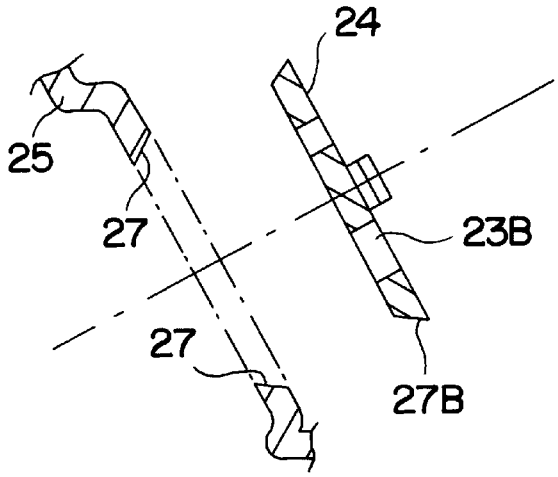

A perspective exploded view of an indoor unit main body of a separate type air conditioner in a first embodiment of the present invention is shown in FIG. 1. A perspective exploded view of its power source board and front grille is shown in FIG. 2(*a*). A sectional view along section 25A of an operation unit 25 and a sectional view along section 24B of an operation switch panel 24 in FIG. 2(*a*) are shown in FIG. 2(*b*).

FIG. 1 shows motor 3 incorporated inside a base frame 2 to drive a cross flow fan 4 as an indoor blower. Front grille 5 is shown attached to base frame 2. Suction port 6 is opened in front grille 5. Indoor air sucked in from suction port 6 passes through an air filter installed behind suction port 6, and flows into indoor heat exchanger 8 assembled in base frame 2. Indoor heat exchanger 8 absorbs heat from the indoor air and dehumidifies it at the same time. This produces a condensate that is poured into water tray 10 provided in diffuser grille 9. Further, the heat-exchanged air passes through diffuser unit 11 of diffuser grille 9, and is blown out from air diffuser 12 opened in front grille 5.

The assembly procedure of the indoor unit main body 1 is described below. The assembly method of the indoor unit main body is schematically shown in FIG. 7. In FIG. 7, the assembly method of the indoor unit main body comprises a step of installing the indoor heat exchanger, indoor blower and power source board in the base frame, and a step of installing the operation members in the power source board. Consequently, the front grille having the operation unit is installed in the base frame so as to cover the indoor heat exchanger and indoor blower. At this time, fitting guides are formed in the operation unit, and as being led by the fitting guides, the operation members are fitted into the front grille.

Referring now to FIG. 1, FIG. 2(*a*), and FIG. 2(*b*), a specific assembly method is described below. Bearing 14 of cross flow fan 4 is fitted into bearing 13 provided in base frame 2. While inserting shaft 17 of motor 3 into fan boss 18 of cross flow fan 4, motor 3 is installed in cross flow fan 4 by means of bolts. Next, indoor heat exchanger 8 is attached to the front of cross flow fan 4. Further, diffuser grille 9 is installed beneath the heat exchanger 8. Power source board 22 incorporating an electronic control device and electrical parts is assembled in base frame 2 ahead of motor 3. By assembling power source board 22, vibration absorbing rubber 15 fitted to both ends of motor 3 is held and set in place.

Various switches 23 as first operation members are arranged and installed in power source board 22. At least one switch out of the various switches 23 has a protrusion for operation. An operation switch panel 24 as a second operation member has a switch hole 23B and an outer casing 27B of an inclined shape. In this embodiment, switches 23 and operation switch panel 24 are defined as operation members. The hole in the operation switch panel 24 is fitted with the protrusion of the switches 23, and the operation switch panel 24 is fitted to the power source board 22. The front grille 5 has an operation unit 25, and this operation unit 25 has an opening 26. The outer casing of opening 26 has a fitting guide 27 to be fitted into an outer casing 27B of operation switch panel 24. Fitting guide 27 has an inclined shape with the outside opening area smaller than the inside opening area. That is, guide 27 of opening 26 has a shape to be fitted to outer casing 27B of operation switch panel 24, and operation switch panel 24 is fitted from inside of front grille 5 to the front grille 5. Outer casing 27B of operation switch panel 24 is led by fitting guide 27, and operation switch panel 24 is fitted into power source board 22, and front grille 5 is installed in base frame 2. Thus, the front grille is assembled in the indoor unit main body 1.

In this constitution, after operation switch panel 24 is installed in power source board 22, front grille 5 is fitted in base frame 2. Alternatively, after operation switch panel 24 is installed in the front grille 5, front grille 5 may be installed in base frame 2.

In this constitution, it is particularly preferred that guide 27 has an inclined shape with the outside opening area smaller than the inside opening area, and that outer casing 27B of operation switch panel 24 has an inclined shape to be fitted with guide 27. Not limited to the inclined structure but the shape of the guide 27 is may be formed so that operation switch panel 24 may be led by guide 27 and fitted into front grille 5.

As an example of a guide mechanism, guide 27 is a groove formed in the outer casing of opening 26, and outer casing 27B of operation switch panel 24 is a protrusion to be guided and fitted into its groove. Guide 27 has a step shape formed on the outer casing of opening 26, and outer casing 27B of operation switch panel 24 has a step shape to be guided and fitted into the step.

In this constitution, operation switch panel 24 is not limited to a rectangular shape but may be formed, for example, in a circular or arbitrary polygonal shape.

In this constitution, the working efficiency for installing the front grille in the indoor unit main body of the separate type air conditioner is notably improved, and the front grille can be installed easily. The operation unit of the front grille and the switches arranged in the power source board can be easily installed at correct positions according to the design specification. During the assembly of the unit before shipping, or during the installation or service of the unit, the number of assembly steps and inspection can be reduced as compared with the conventional method.

Exemplary Embodiment 2

FIG. 3 is a perspective exploded view showing another method of assembly. In FIG. 3, first, power source board 22 having various switches 23 is installed in base frame 2. Front grille 5 has an operation unit 25 forming opening 26. Fitting guide 27 having a side inclined to the outside is formed in the outer casing of opening 26. Fitting guide 27 has a shape when the outside opening area is larger than the inside opening area. Front grille 5 is installed in base frame 2 having power source board 22. Moreover, detachable operation switch panel 28 is fitted into opening 26 of operation unit 25 from the front side of front grille 5. Operation switch panel 28 has an outer casing of an oblique shape to be fitted to fitting guide 27. Operation switch panel 28 has a switch hole 32. When operation switch panel 28 is fitted into opening 26, operation switch panel 28 is led by fitting guide 27 and is fitted, while the protrusion of switch 23 is fitted into switch hole 32.

In this constitution, operation switch panel 28 is first fitted into front grille 5, and then front grille 5 is installed in base frame 2. Alternatively, front grill 5 may be first fitted into base frame 2, and then operation switch panel 28 may be installed in front grille 5.

In this constitution, it is particularly preferred that guide 27 has an inclined shape with the outside opening area larger than the inside opening area, and that the outer casing of operation switch panel 28 has, but not limited to, an inclined shape to be fitted with guide 27. The shape of the guide 27 may be formed, for example, so that operation switch panel 28 may be led by guide 27 and fitted into front grille 5.

An example of such guide mechanism guide 27 is a groove formed in outer casing of the opening 26, and outer casing of the operation switch panel 28 is a protrusion to be guided and fitted into its groove. Guide 27 has a step shape formed on outer casing of the opening 26, and outer casing of the operation switch panel 28 has a step shape to be guided and fitted into the step.

In this constitution, the operation switch panel 28 is, but not limited to a rectangular. shape For example, operation switch panel 28 may be formed in a circular or arbitrary polygonal shape.

In this constitution, the same effects as the effects explained in embodiment 1 are obtained.

Exemplary Embodiment 3

FIG. 4 is a perspective exploded view showing a different method of assembly. In FIG. 4, the indoor unit comprises a base frame 2, a power source board 22, an electronic control device 31, and a front grill 5. The electronic control device 31 includes a printed circuit board 54, a display unit 29 having an operation lamp, a timer lamp, and others installed in the printed circuit board 54, and a switch unit 30 having an automatic operation switch, a test run switch, and others. Front grille 5 has an operation unit 25, and operation unit 25 has an opening for installing electronic control device 31. Power source board 22 is installed in base frame 2. Electronic control device 31 is installed in the opening of operation unit 25. Front grille 5 is fitted to base frame 2, and electronic control device 31 is connected to a control device (not shown) of power source board 22, connector, and others. Thus, front grille 5 is installed in indoor unit main body 1.

In this constitution, the front grille can be installed easily and securely. Further, front grille 5 can be installed in the indoor unit main body 1 without interfering or applying abnormal stress to switches 23. Furthermore, since the display unit and the switches are installed in the front grille, if the power source board installed in the indoor unit main body is slightly deviated from the design specification due to a dimensional error or an assembly error of the parts, it can be installed in the specified position conforming to the design specification.

Exemplary Embodiment 4

Figure 5A:
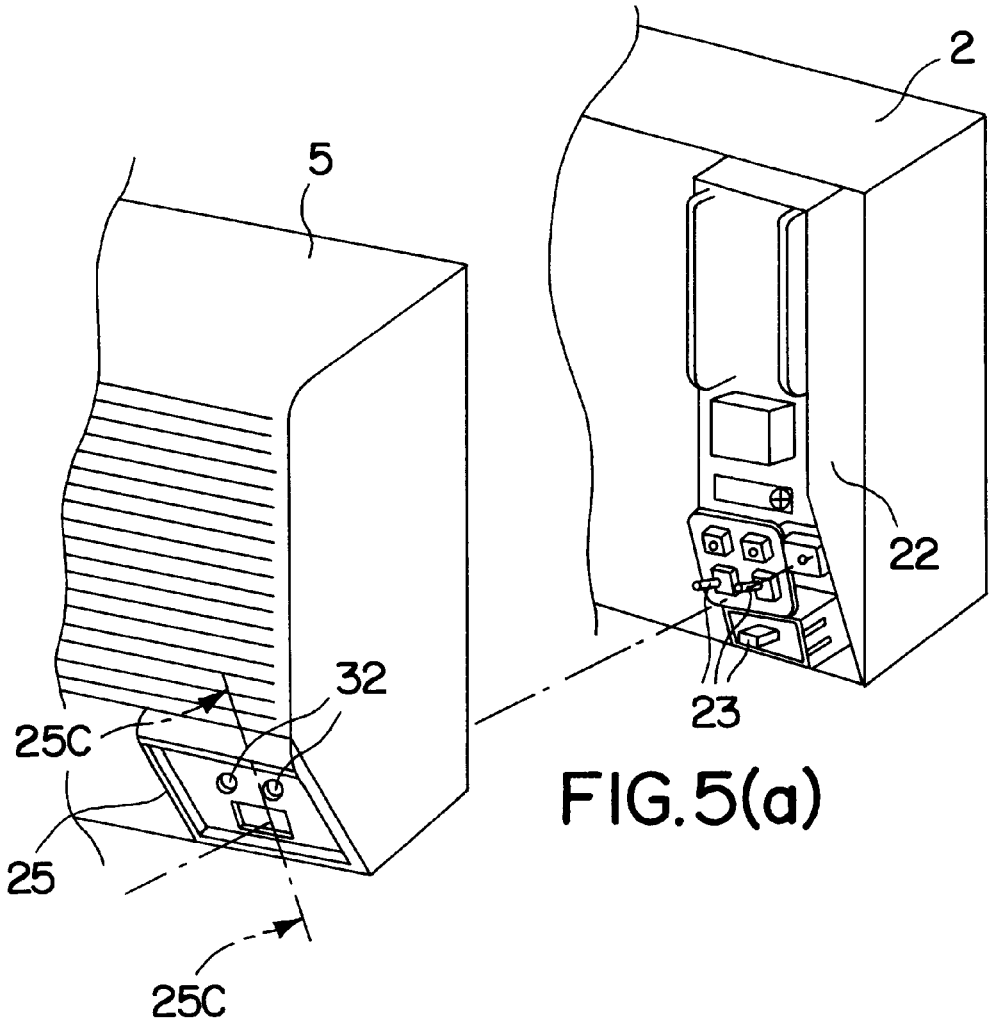
FIG. 5(*a*) is a further perspective exploded view of a power source board and a front grille of the separate type air conditioner shown in FIG. 1.
Figure 5B:
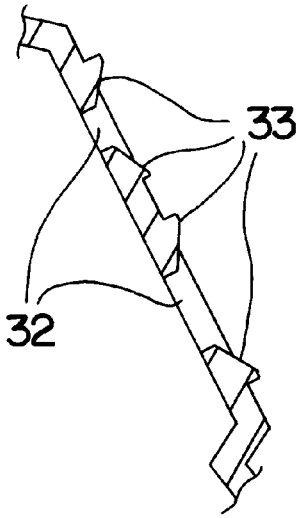

FIG. 5(*a*) is a perspective exploded view showing a further different assembly method, and FIG. 5(*b*) is a sectional view along section 25C of operation unit 25 in FIG. 5(*a*). In FIG. 5(*a*) and FIG. 5(*b*), various switches 23 are installed in power source board 22, and power source board 22 is installed in base frame 2. At least one of switches 23 has a protrusion to be operated. Front grille 5 has operation unit 25, and the operation unit 25 has a switch hole 32. Guide 33 is formed integrally with the front grille 5 on the outer casing of switch holes 32. Switch 23 is designed to be led by guide 33. The protrusion of switch 23 is led by guide 33 of switch hole 32, and, as being fitted, front grille 5 is installed in base frame 2. Thus, front grille 5 having switch hole 32 is installed in indoor unit main body 1.

In the embodiment, it is particularly preferred that guide 33 has an inclined shape with the outside opening area smaller than the inside opening area, and that the outer casing of the switch 23 has, but is not limited to, an inclined shape to be fitted with guide 27. The shape of the guide 27 may be, for example, formed so that switch 23 may be led by guide 27 and fitted into front grille 5. For example, guide 27 can have a step shape formed in switch hole 32, and switch 23 has a step shape to be fitted as being led by this step.

In this constitution, front grille 5 can be installed easily. Further, at a lower cost, front grille 5 can be installed in the indoor unit main body 1 without interfering or applying abnormal stress to switches 23.

Exemplary Embodiment 5

Figure 6A:
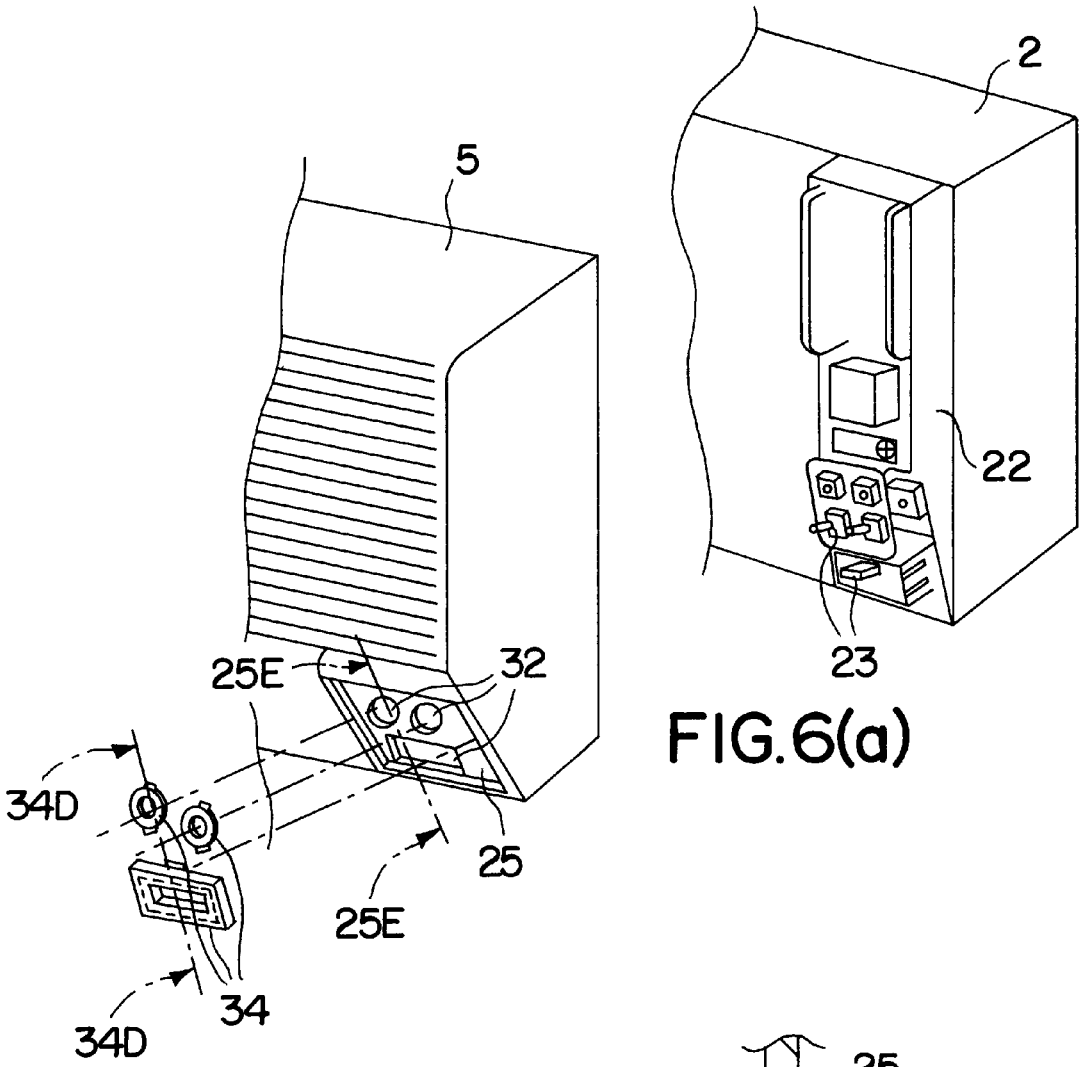
FIG. 6(*a*) is an exploded view from different perspective of a power source board and a front grille of the separate type air conditioner shown in FIG. 1.
Figure 6B:
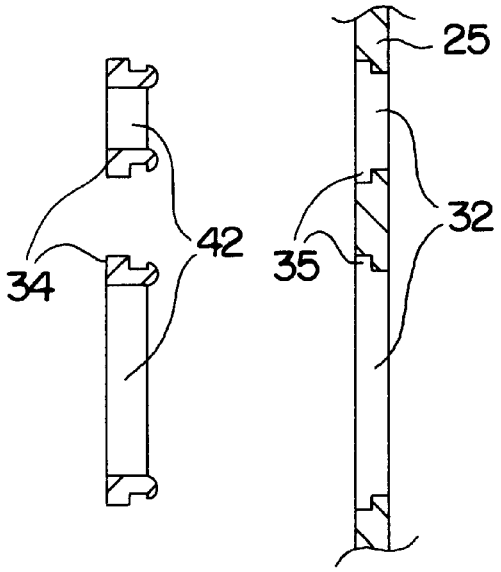
Figure 8:
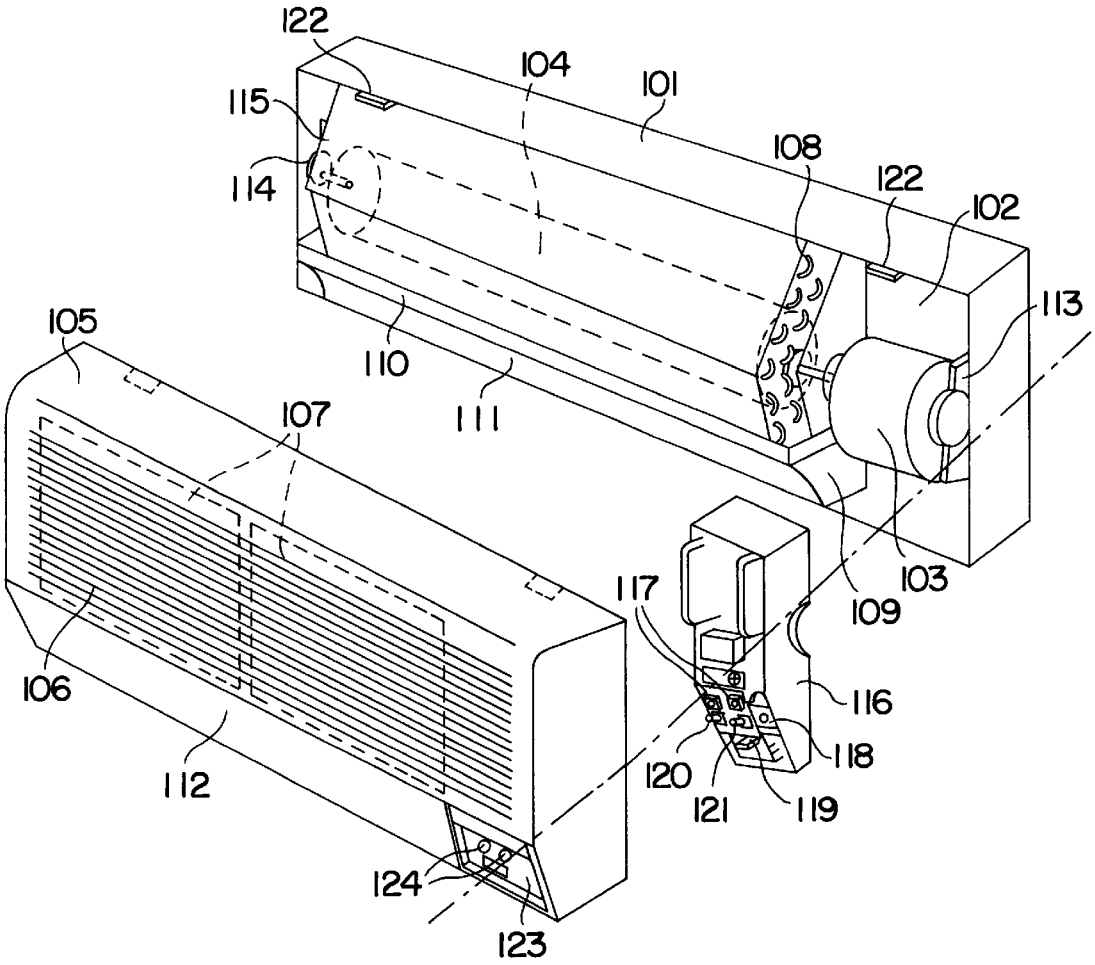
FIG. 8 PRIOR ART
FIG. 8 is a perspective exploded view of a conventional separate type air conditioner.

FIG. 6(*a*) is a perspective exploded view showing a further assembly method FIG. 6(*b*) is a sectional view along section 6(*b*)—6(*b*) of operation unit 25. FIG. 6(*c*) is a section view along section 6(*c*)—6(*c*) of switch hole lid 34. In FIG. 6 (*a*), FIG. 6(*b*), and FIG., 6(*c*) various switches 23 are installed in a power source board 22, and power source board 22 is installed in base frame 2. At least one of switches 23 has a protrusion to be operated. Front grille 5 has an operation unit 25, and operation unit 25 has various switch holes 32. Switch holes 32 are opened larger than the design specifications. Detachable switch hole lid 34 is fitted on switch holes 32. Switch hole lid 34 has a second switch hole 42. Fitting guide 35 is disposed on the outer casing of switch hole lid 34. Switch hole lid 34 is made of a separate part. The protrusion of switch 23 is led by fitting guide 35, and is installed in second switch hole 42, and then front grille 5 is assembled in base frame 2. Thus, front grille 5 having switch holes 32 is installed in the indoor unit main body 1.

In this constitution, after switch hole lid 34 is fitted into operation unit 25, the front grille is fitted into base frame 2. Alternatively, after the front grille 5 is fitted into base frame 2, switch hole lid 34 may fitted into operation unit 25.

In this constitution, the shape of the switch hole lid 34 is not particularly limited, and, for example, it may be formed in a circular or polygonal shape.

In the constitution, the front grille can be installed easily. Incidentally, the die for forming and manufacturing the front grille is more complicated and larger in size in the conventional manufacture of the front grille because various switch holes of the operation unit are drawn by a slide mechanism. However, by forming the switch hole lid as a separate part, as in this embodiment, the front grille may be formed in a simple shape, so that the die may be smaller and inexpensive. Still more, the front grille can be installed without interfering or applying abnormal stress to the switch. In addition, the front grille having a larger opened switch hole can present an appearance of a high commercial value from a design viewpoint.

The effects obtained from these features are listed below.

The working efficiency is improved substantially when installing the front grille in the indoor unit main body of a separate type air conditioner, and the front grille can be installed easily.

Further, the operation unit of the front grille, and various switches arranged in the power source board can be installed easily at correct positions conforming to the design dimensions, so that merchandise of stable quality can be presented.

Moreover, in the assembly of the unit before shipping, or in the installation or service work, the number of assembling steps and inspection items can be reduced as compared with the conventional method.

The front grille 5 can be installed at lower cost in the indoor unit main body 1 without interfering or applying abnormal stress to switches 23.

The die for forming and manufacturing the front grille is more complicated and larger in size in the conventional manufacture of front grille because various switch holes of the operation unit are drawn by a slide mechanism. However, by forming the operation switch panel, switch hole lid and others as separate parts, as in the above described embodiments, the front grille may be formed in a simple shape, so that the die may be smaller and inexpensive.

Still more, the front grille having a larger opened switch hole can have an appearance of a high commercial value from a design viewpoint.

In particular, in the constitution in which the display unit and various switches are installed in the front grille, if the power source board mounted on the indoor unit main body is deviated slightly from the design dimensions due to dimensional errors or assembly errors of parts, it can be installed at correct position according to the design specifications. The front grille can be securely and easily installed.

In particular, by integrally forming a fitting guide in an outer casing shape of various switch holes of the operation unit provided in the front grille, the front grille can be installed in the indoor unit main body, at lower cost, without interfering or applying abnormal stress to the switches.

In particular, by forming a switch hole lid having a switch hole of design dimensions, and fitting the switch hole lid into the operation unit of the front grille, the front grille having a larger opened switch hole can have an appearance of a high commercial value from a design viewpoint.

What is claimed is:

1. An air conditioner comprising, an indoor unit including:

(a) a base frame, (b) a power source board having a control device, (c) an operation member mounted on said power source board, and (d) a front grille having an operation unit being coupled to said base frame to cover said power source board, and an outdoor unit, wherein said operation unit has a guide, said operation member has a fitting portion, said fitting portion of said operation member is fitted to said guide, and thereby said operation member is fitted into said front grille.

2. An air conditioner of claim 1 further comprising:

(e) a heat exchanger coupled to said base frame, and (f) an indoor fan coupled to said base frame, wherein said front grille has an air suction port and an air diffuser.

3. An air conditioner of claim 1, said outdoor unit comprising:

an outdoor air circuit having an outdoor air suction port, an outdoor fan, and an outdoor air diffuser, an outdoor heat exchanger, a compressor, and an outdoor wiring board.

4. An air conditioner of claim 1 further comprising:

a refrigeration cycle for providing circulation between said indoor unit and said outdoor unit.

5. An air conditioner of claim 1, wherein said operation unit has an opening, said guides are formed on the outer casing of said opening, said operation member has a switch and operation switch panels, and said operation switch panel is fittable into said opening.

6. An air conditioner of claim 1, wherein said operation unit has an opening, said guides are formed on the outer casing of said opening, said operation member has a switch and an operation switch panel detachable from said switch, and said operation switch panel is disposed in said opening.

7. An air conditioner of claim 6, wherein said guides have an inclined shape having an outside opening area smaller than an inside opening area, and said operation switch panel has an inclined shape fittable to said inclined shape.

8. An air conditioner of claim 1, wherein said operation unit has an opening, said guides are formed on the outer casing of said opening, said operation member has a switch and an operation switch panel detachable from said switch, and said operation switch panel is fitted to said switch installed in said power source board, and is disposed in said opening.

9. An air conditioner of claim 8, wherein said guides have an inclined shape having the outside opening area larger than the inside opening area, and said operation switch panel has an inclined shape fittable to said inclined shape.

10. An air conditioner comprising, an outdoor unit including:

(a) a base frame, (b) a power source board having a control device, (c) an operation member mounted on said power source board, and (d) a front grille having an operation unit, being coupled to said base frame to cover said power source board, wherein said operation unit has guides, and said operation members are coupled to said guide s and fitted to said front grille; and an outdoor unit, wherein said operation member has a switch, an operation lamp, a timer lamp, and an electronic control device.

11. An air conditioner of claim 1, wherein an opening is formed in said operation unit, said guides are formed on the outer casing of said opening, said operation member has a printed circuit board, and an electronic control device installed in said printed circuit board, said operation member is disposed in said power source board, and said operation member disposed in said power source board is installed so as to be fitted into said opening of said front grille.

12. An air conditioner of claim 1, wherein said operation member has a switch, said operation unit has a switch opening, said guides are formed on the outer casing of said switch opening, and said switch is led by said guides and fitted into said switch opening, and said front grille can be disposed in said base frame.

13. An air conditioner of claim 1, wherein said operation member has a switch, said operation unit has a switch opening, and an opening lid detachable from said switch opening, said opening lid having guides, said switch is fitted into said opening lid, and said front grille coupled to said base frame.

14. A method of assembling an air conditioner, (a) installing a power source board in a base frame, (b) installing operation member in said power source board, and (c) installing a front grille incorporating an operation unit to said base frame to cover said power source board, said operation unit having a guide and said operation member having a fitting portion, wherein said operation member is to said operation unit by coupling said fitting portion to said guide and thereof said operation member is fitted into said front grille.

15. An assembly method of claim 14, wherein said operation unit has an opening, said guides are formed on the outer casing of said opening, said operation member has a switch and operation switch panels directed by said guides and are fitted into said opening, and said operation member is fitted into said front grille.

16. A method of assembly of an air conditioner according to claim 14, wherein said operation unit has an opening, said guides are formed on the outer casing of said opening, said operation member has a switch and an operation switch panel detachable from said switch, said operation switch panel having a switch opening, and is fitted into said opening by being directed by said guide from the inside of said front grille, a protrusion of said switch is inserted into said switch opening, and said operation member is fitted into said front grille.

17. A method of assembly of an air conditioner according to claim 14, wherein said operation unit has an opening, said guides are formed on the outer casing of said opening, said operation member has a switch and an operation switch panel detachable from said switch, said operation switch panel has a switch opening disposed in said power source board, a protrusion of said switch is disposed into said switch opening, and said operation switch panel is installed in said switch, said operation switch panel is directed by said guides, and is fitted into said opening from inside of said front grille, and said operation member is fitted into said front grille.

18. A method of assembly of an air conditioner according to claim 14, wherein said operation unit has an opening, said guides are formed on the outer casing of said opening, said operation member has a switch and an operation switch panel detachable from said switch, said operation switch panel has a switch opening installed in said power source board, said operation switch panel is directed by said guides, and is fitted into said opening from inside of said front grille, and said operation member is fitted into said front grille, while a protrusion of said switch is simultaneously inserted into said switch opening.

19. A method of assembly of an air conditioner according to claim 14, wherein said operation unit has an opening, said guides are formed on the outer casing of said opening, said operation member has a switch and an operation switch panel detachable from said switch, said operation switch panel has a switch hole fitted into said switch installed in said power source board, and is directed by said guides, and is fitted into said opening from outside of said front grille, a protrusion of said switch is inserted into said switch opening , and said operation member is fitted into said front grille.

20. A method of assembly of an air conditioner according to claim 14, wherein said operation unit has an opening, said guides are formed on the outer casing of said opening, said operation member has a switch and an operation switch panel detachable from said switch, said operation switch panel has a switch hole disposed in said power source board, then said front grille is fitted in said base frame, and then said operation switch panel is directed by said guides, and is fitted into said opening from outside of said front grille, and a protrusion of said switch is inserted into said switch opening, and said operation switch panel is disposed in said switch and said opening.

21. A method of assembling an air conditioner according to claim 14, wherein said operation unit has an opening, said guides are formed on the outer casing of said opening, said operation member has a switch and an operation switch panel detachable from said switch, said operation switch panel has a switch hole disposed in said power source board, and said operation switch panel is directed by said guides, and is fitted into said opening from outside of said front grille, and said front grille disposed in said operation switch panel is fitted into said base frame, and a protrusion of said switch is inserted into said switch opening.

22. A method of assembly of an air conditioner, comprising the steps of:

(a) installing a power source board in a base frame, (b) installing operation member in said power source board, and (c) installing a front grille incorporating an operation unit in said base frame to cover said power source board, said operation member is fitted into said front grille by being directed by guides, wherein said operation member has a switch, an operation lamp, a timer lamp, and an electronic control device.

23. A method of assembly of an air conditioner according to claim 14, wherein an opening is formed in said operation unit, said guides are formed on the outer casing of said opening, said operation member having a printed circuit board, and an electronic control device disposed in said printed circuit board, and is fitted into said opening of said front grille, so that said operation member is fitted into said front grille.

24. A method of assembly of an air conditioner according to claim 14, wherein said operation member has a switch, said operation unit has a switch opening formed integrally in said operation unit, said guides are formed on the outer casing of said switch opening, and said switch is directed by said guides and is fitted into said switch opening, and said front grille is disposed in said base frame.

25. A method of assembly of an air conditioner according to claim 14, said guides having an inclined shape smaller in the outside area of the switch hole than in the inside area, and said switch is led by said inclined shape, and is inserted into said switch opening.

26. A method of assembly of an air conditioner according to claim 14, wherein said operation member has a switch, said operation unit has a switch opening, and a opening lid detachable from said switch opening directed said guides, and fitted into said opening lid, and said front grille is disposed in said base frame.

27. A method of assembly of an air conditioner according to claim 14, wherein said operation member has a switch, said operation unit has a switch opening, and a opening lid detachable from said switch opening disposed in said power source board, said opening lid is disposed in said switch hole, and said front grille disposed in said opening lid is fitted to said base frame, and a protrusion of said switch is led by said guide, and is fitted into said opening lid.

28. A method of assembly of an air conditioner according to claim 14, wherein said operation member has a switch, said operation unit has a switch hole, and a hole lid detachable from said switch opening disposed in said power source board, said front grille is disposed in said base frame, and said opening lid is disposed in said switch opening, and a protrusion of said switch is led by said guides, and is fitted into said hole lid.

29. The air conditioner of claim 1, wherein said fitting portion of said operation member includes an outer casing of an inclined shape.

30. The method of assembly of an air conditioner according to claim 14, wherein said fitting portion of said operation member includes an outer casing of an inclined shape.

31. An air conditioner comprising, an indoor unit including:

(a) a base frame, (b) a power source board having a control device, (c) an operation member mounted on said power source board, (d) a front grille having an operation unit, being coupled to said base frame to cover said power source board, wherein said operation unit has a guide, and said operation members is led by said guide and fitted into said front grille;

an outer unit; and a refrigeration cycle for providing circulation between said indoor unit said outdoor unit.

32. The air conditioner of claim 31 further comprising:

(e) an indoor heat exchanger disposed in said base frame, and (f) an indoor fan installed in said base frame, wherein said front grille has an indoor air suction port and an indoor air diffuser.

33. The air conditioner of claim 31, wherein said outdoor unit comprises:

an outdoor air circuit having an outdoor air suction port, an outdoor blower, and an outdoor air diffuser, an outdoor heat exchanger, a compressor and an outdoor wiring board.

34. The air conditioner of claim 31, wherein said operation unit has a opening, said guide is formed on the outer casing of said opening, said operation member has a switch and operation switch panels, and said operation switch panel is fitted into said opening by being led by said guide.

35. The air conditioner of claim 31, wherein said operation unit has an opening, said guide is formed on an outer casing of said opening, said operation member has a switch and an operation switch panel detachable from said switch, and said operation switch panel is disposed in said opening by being led by said guide from the inside of said front grille.

36. The air conditioner of claim 35, wherein said guide has an inclined shape having an outside opening area smaller than an inside opening area, and said operation switch panel has an inclined shape.

37. The air conditioner of claim 31, wherein said operation unit has an opening, said guide is formed on the outer casing of said opening, said operation member has a switch and an operation switch panel detachable from said switch, and said operation switch panel is fitted to said switch installed in said power source board, and is disposed in said opening by being led by said guide from the outside of said front grille.

38. The air conditioner of claim 37, wherein said guide has an inclined shape having an outside opening area larger than an inside opening area, and said operation switch panel has an inclined shape.

39. The air conditioner of claim 31, wherein said operation member has at least one selected from the group consisting of a switch, an operation lamp, a timer lamp, and an electronic control device.

40. The air conditioner of claim 31, wherein an opening is formed in said operation unit, said guide is formed on the outer casing of said opening, said operation member has a printed circuit board, and an electronic control device installed in said printed circuit board, said operation member is disposed in said power source board, and said operation member disposed in said power source board is installed so as to be fitted into said opening of said front grille.

41. The air conditioner of claim 31, wherein said operation member has a switch, said operation unit has a switch opening, said guides are formed on the outer casing of said switch opening, and said switch is led by said guides and fitted into said switch opening, and said front grille is be disposed in said base frame.

42. The air conditioner of claim 31, wherein said operation member has a switch, said operation unit has a switch opening, and an opening lid detachable from said switch opening, said opening lid having said guide, said switch is fitted into said opening lid, and said front grille is coupled to said base frame.

43. A method of assembling an air conditioner, said air conditioner comprising an indoor unit, an outdoor unit and a refrigeration cycle for providing circulation between said indoor unit and said outdoor unit, said method comprising:

(a) installing a power source board in a base frame, (b) installing an operation member in said power source board, and (c) installing a front grille incorporating an operation unit in said base frame to cover said power source board, said operation member is fitted into said front grille, by being led by a guide formed in said operation unit.

44. The assembling method of claim 43, wherein said operation unit has an opening, said guide is formed on the outer casing of said opening, said operation member has a switch and operation switch panels, and said step (c) including, leading said operation switch panel by said guide, and fitting said operation switch panel into said opening, wherein said operation member is fitted into said front grille.

45. The assembling method of claim 43, wherein said operation unit has an opening, said guide is formed on the outer casing of said opening, said operation member has a switch and an operation switch panel detachable from said switch, said operation switch panel having a switch opening, said step (b) and step (c) including the steps of, fitting said operation switch panel into said opening by being led by said guide from the inside of said front grille, installing a protrusion of said switch into said switch opening, and fitting said operation member into said front grille.

46. The assembling method of claim 43, wherein said operation unit has an opening, said guide is formed on the outer casing of said opening, said operation member has a switch and an operation switch panel detachable from said switch, said operation switch panel has a switch opening said step (b) and step (c) include the steps of installing said switch in said power source board, then installing a protrusion of said switch into said switch hole, and installing said operation switch panel in said switch, and then leading said operation switch panel by said guide, and fitting said operation switch panel into said opening from inside of said front grille, wherein said operation member is fitted into said front grille.

47. The assembling method of claim 43, wherein said operation unit has an opening, said guide is formed on the outer casing of said opening, said operation member has a switch and an operation switch panel detachable from said switch, said operation switch panel has a switch hole, said step (b) and step (c) including the steps of, installing said switch in said power source board, then leading said operation switch panel by said guide, and fitting into said opening from inside of said front grille, and then fitting said operation member into said front grille, while a protrusion of said switch is simultaneously inserted into said switch hole.

48. The assembling method of claim 43, wherein said operation unit has an opening, said guide is formed on an outer casing of said opening, said operation member has a switch and an operation switch panel detachable from said switch, said operation switch panel has a switch hole, said step (b) and step (c) including the steps of, fitting said operation switch panel into said switch installed in said power source board,by leading by a fitting guide, and fitting into said opening from outside of said front grille, inserting a protrusion of said switch into said switch hole, and fitting said operation member into said front grille.

49. The assembling method of claim 43, wherein said operation member has at least one selected from the group consisting of an operation lamp, a timer lamp, and an electronic control device.

50. The assembling method of claim 43, wherein an opening is formed in said operation unit, said guide is formed on an outer casing of said opening, said operation member has a printed circuit board, and an electronic control device disposed in said printed circuit board, and said step (c) including the steps of, installing said operation member having the printed circuit board and electronic device in said power source board, and fitting said operation member in said power source board into said opening of said front grille, so that said operation member is fitted into said front grille.

51. The assembling method of claim 43, wherein said operation member has a switch, said operation unit has a switch opening formed integrally in said operation unit, said guide is formed on an outer casing of said switch hole, and said step (c) including the step of, leading said switch by said guide and fitting into said switch hole, wherein said front grille is disposed in said base frame.

52. The assembling method of claim 43, wherein said operation member has a switch, said operation unit has a switch opening, and a opening lid detachable from said switch opening, said opening lid has said guide, said step (c) including leading said switch by said guide, and fitting into said opening lid, wherein said front grille is disposed in said base frame.

* * * * *

UNITED STATES PATENT AND TRADEMARK OFFICE

CERTIFICATE OF CORRECTION

PATENT NO. : 6,189,328 B1
DATED : February 20, 2001
INVENTOR(S) : Koji Mochizuki It is certified that error appears in the above-identified patent and that said Letters Patent is hereby corrected as shown below:

Column 9,
Line 20, delete the space between "guide" and "s" to read: -- guides --

Column 13,
Line 9, change "a" to "an" between "has" and "opening" to read: -- has an opening --

Signed and Sealed this

Second Day of October, 2001

*Attest:*

Nicholas P. Godici

NICHOLAS P. GODICI

*Attesting Officer*

*Acting Director of the United States Patent and Trademark Office*